US009362631B2

(12) United States Patent
Listing et al.

(10) Patent No.: US 9,362,631 B2
(45) Date of Patent: Jun. 7, 2016

(54) SHIELD SLEEVE HAVING A SLEEVE MEMBER WITH A PROTRUDING CONTACT FINGER

(71) Applicant: Tyco Electronics Services GmbH, Bensheim (DE)

(72) Inventors: Martin Listing, Langen (DE); Gerzson Toth, Mannheim (DE); Andre Martin Dressel, Lampertsheim (DE); Frank Kaehny, Lautertal (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/575,359

(22) Filed: Dec. 18, 2014

(65) Prior Publication Data

US 2015/0099397 A1 Apr. 9, 2015

Related U.S. Application Data

(63) Continuation of application No. PCT/IB2013/054873, filed on Jun. 14, 2013.

(30) Foreign Application Priority Data

Jun. 18, 2012 (DE) ..... 10 2012 105 258

(51) Int. Cl.

| | |
|---|---|
| ***H01R 9/03*** | (2006.01) |
| ***H01R 4/64*** | (2006.01) |
| ***H01R 9/05*** | (2006.01) |
| ***H01R 13/6582*** | (2011.01) |

(52) U.S. Cl.

CPC ..... *H01R 4/646* (2013.01); *H01R 9/0527* (2013.01); *H01R 13/6582* (2013.01)

(58) Field of Classification Search

CPC ..... H01R 13/648; H01R 13/6485; H01R 13/658; H01R 13/6581; H01R 13/6582

USPC ..... 439/607.41, 607.5, 607.54, 607.04

See application file for complete search history.

(56) References Cited

U.S. PATENT DOCUMENTS

| | | | | |
|---|---|---|---|---|
| 5,938,475 | A * | 8/1999 | Penner | H01R 9/0527 439/607.44 |
| 6,099,351 | A * | 8/2000 | Wu | H01R 12/725 439/541.5 |
| 7,588,461 | B2 * | 9/2009 | Tyler | B60L 3/0069 439/607.41 |
| 7,758,381 | B2 * | 7/2010 | Oki | H01R 13/65802 439/607.17 |
| 8,152,537 | B1 | 4/2012 | Montena | |
| 8,241,063 | B2 * | 8/2012 | Nagata | H01R 12/724 439/345 |

FOREIGN PATENT DOCUMENTS

DE 3518159 A1 11/1986

OTHER PUBLICATIONS

PCT Notification, PCT International Search Report and Written Opinion of the International Searching Authority, International Application No. PCT/IB2013/054873, dated Sep. 10, 2013, 8 pages.

* cited by examiner

*Primary Examiner* — Chandrika Prasad
(74) *Attorney, Agent, or Firm* — Barley Snyder

(57) ABSTRACT

A shield sleeve is disclosed having a sleeve member. The sleeve member has a first end, and at least one radially protruding contact finger. Each contact finger has a cantilevered end connected to the first end, and at least one contacting protrusion positioned proximate to an opposite free end and protruding outward in a radial direction with respect to the sleeve member.

13 Claims, 7 Drawing Sheets

SHIELD SLEEVE HAVING A SLEEVE MEMBER WITH A PROTRUDING CONTACT FINGER

CROSS-REFERENCE TO RELATED APPLICATION

This application is a continuation of PCT International Application No. PCT/IB2013/054873 filed Jun. 14, 2013, which claims priority under 35 U.S.C. §119 to German Patent Application No. 102012105258.1, filed Jun. 18, 2012.

FIELD OF THE INVENTION

The invention is generally related to an electrical connection-forming shield sleeve, and more specifically, a shielding end element having a shield sleeve and a crimp sleeve.

BACKGROUND

Convention shield sleeves have a cylindrical sleeve member where a circular ring is disposed on one end. The ring generally extends perpendicular relative to the cylinder axis and consequently perpendicular relative to the direction of the cable. A cable shielding layer is positioned on the cylindrical sleeve member and secured by a crimping sleeve fitted over the sleeve member and the cable shielding layer and crimped therewith. Electrical connectivity between the cable shielding layer and shield sleeve is thereby produced.

To produce an electrical connection with a connection element of the cable, the ring is pressed along an axial direction onto a metal housing member of the cable connection element. In order to produce a secure and uniform contact between the shield sleeve and the metal housing ember, an annular corrugated spring is positioned therebetween. The annular corrugated spring often has protrusions along the axial direction such that the protrusions form contact locations between the shield sleeve and the metal housing member.

With such conventional shield sleeves, the contact force, and consequently, the contact resistance are highly dependent on the connection and the force between the housing portions of the cable connection element. Furthermore, the contact resistance is relatively high.

There is need for a shield sleeve which ensures a secure, consistent contact resistance which is substantially independent of forces between the housing members of a cable connection element.

SUMMARY

A shield sleeve has a sleeve member. The sleeve member has a first end, and at least one radially protruding contact finger. Each contact finger has a cantilevered end connected to the first end, and at least one contacting protrusion positioned proximate to an opposite free end and protruding outward in a radial direction with respect to the sleeve member.

BRIEF DESCRIPTION OF THE DRAWINGS

The invention will now be described by way of example, with reference to the accompanying Figures, of which.

DETAILED DESCRIPTION OF THE EMBODIMENT(S)

Figure 1:
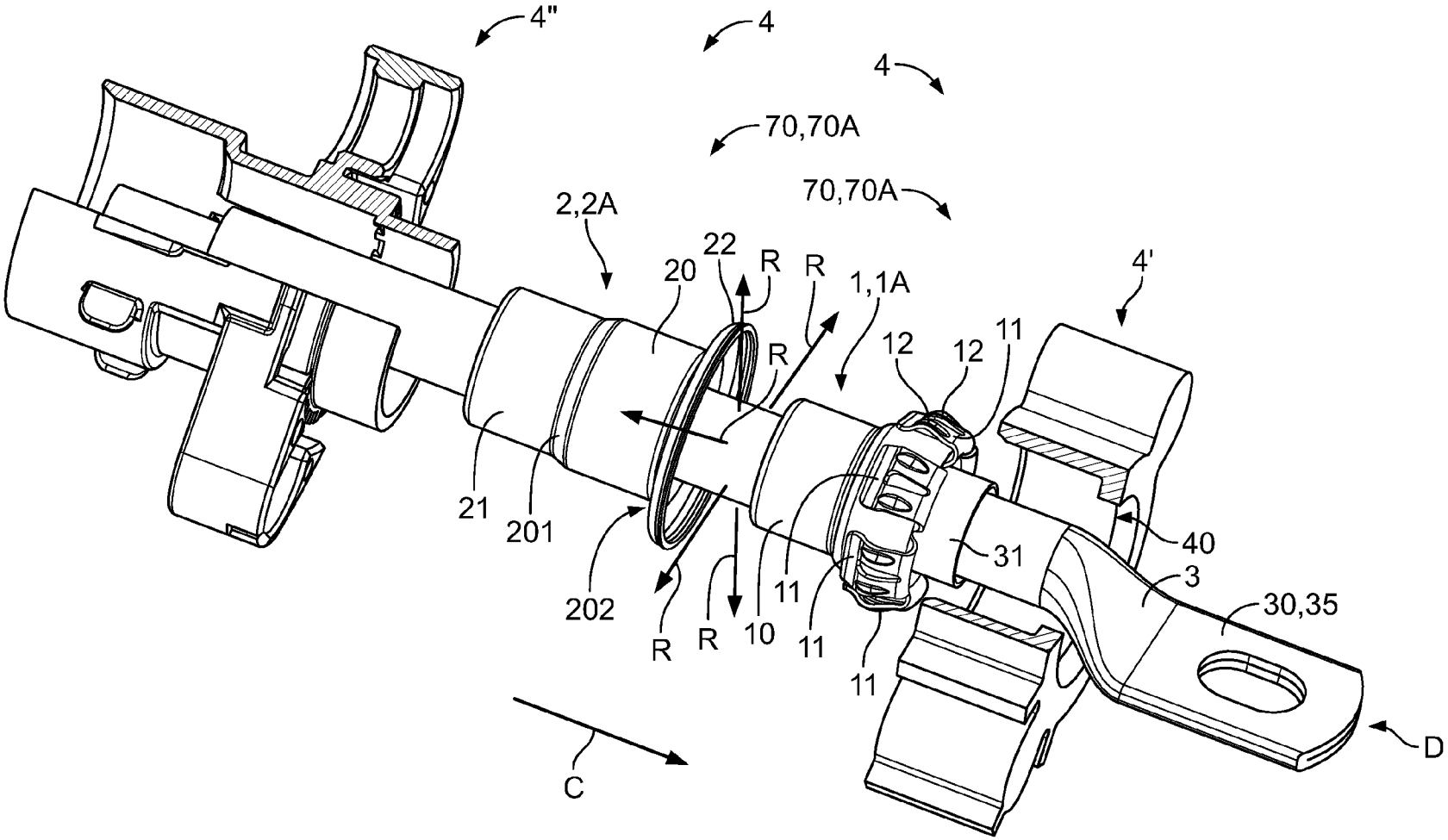
FIG. 1 is an exploded view of a shield sleeve, a crimp sleeve, a housing, and a cable in a preassembly state.

A shield sleeve 1, together with a crimp sleeve 2, a cable 3 and a housing 4, form a first housing 4' and a second housing 4". In an embodiment of FIG. 1, a shield sleeve 1A, together with a crimp sleeve 2A, a cable 3 and a housing 4, form a first housing 4' and a second housing 4". In an embodiment of FIG. 4, a shield sleeve 1B, together with a crimp sleeve 2B, a cable 3 and a housing 4, form the first housing 4' and the second housing 4"

The shield sleeve 1 and the crimp sleeve 2 are fitted on the cable 3 and positioned one behind the other along a longitudinal axis, which corresponds to a cable direction C.

The cable 3 comprises an internal conductor 30, an intermediate insulating layer 31 and a cable shielding layer (not shown) positioned over the intermediate insulating layer 31, and an outer insulating layer (not shown) positioned over the cable shielding layer (not shown). The conductor 30 of the cable 3 has a contact member 35 positioned on a distal end D, which serves to produce contact with a corresponding contact element (not shown).

The shield sleeve 1 has a first sleeve crimping member 10, which serves to produce a crimp connection with a second sleeve crimping member 20 of the crimp sleeve 2. In order to achieve an electrical contact with the cable shielding layer, the cable shielding layer is placed on the first sleeve crimping member 10 of the shield sleeve 1, the crimp sleeve 2 is fitted on the shield sleeve 1, and the second sleeve crimping member 20 of the crimp sleeve is crimped with the first sleeve crimping member 10 of the shield sleeve 1. The cable shielding layer is thereby secured between the first and second crimping members 10, 20 and the first and second sleeve crimping members 10, 20 are both mechanically connected to each other. Further, the cable shielding layer and the first and second sleeve crimping members 10, 20 are electrically connected together.

The crimp sleeve 2 has a cable crimping member 21, through which the crimp sleeve 2 can be crimped with the cable 3. A relative movability of the cable 3 with respect to the crimp sleeve 2 and consequently the shield sleeve 1 is thereby limited.

To receive the first sleeve crimping member 10 of the shield sleeve 1, the second sleeve crimping member 20 of the crimp sleeve 2 has a shield sleeve receiving space (not labeled) having a larger diameter than a cable receiving space (not labeled) of the cable crimping member 21. The crimp sleeve 2 is rotationally symmetrical, having the cylindrical second sleeve crimping member 20, the cylindrical cable crimping member 21, a first transition member 201 extending conically between the second sleeve crimping member 20 and the cable crimping member 21, a shield sleeve receiving member 22, and a second transition member 202 extending conically between the second sleeve crimping member 20 and the shield sleeve receiving member 22.

The housing 4 includes an electrically conductive metal first housing 4' and a second housing 4". In an embodiment, the second housing 4" is made of an electrically conductive metal. In another embodiment, the second housing 4" is made of non-metallic material.

As described in the embodiments above, the crimp sleeve 2 is connected to the shield sleeve 1. Subsequently, the shield sleeve 1 and the crimp sleeve 2 are inserted into the metal first housing 4' in the cable direction C. The second housing 4" is then connected to the first housing 4' in the cable direction C, as seen in an embodiment of FIG. 3.

To ensure an electrical connection between the shield sleeve 1 and the metal first housing 4', the shield sleeve 1 has a plurality of radially protruding, contact fingers 11 which are resilient in a radial direction R. In an embodiment of FIG. 1 the contact fingers 11A have contacting protrusions 12 which, in the assembled state, contact an inner edge 40 of the first housing 4'. The contacting protrusions 12 protrude the radial direction R relative to the contact fingers 11 so that the shield sleeve 1 contacts the first housing 4' only at the contacting protrusions 12.

Figure 2:
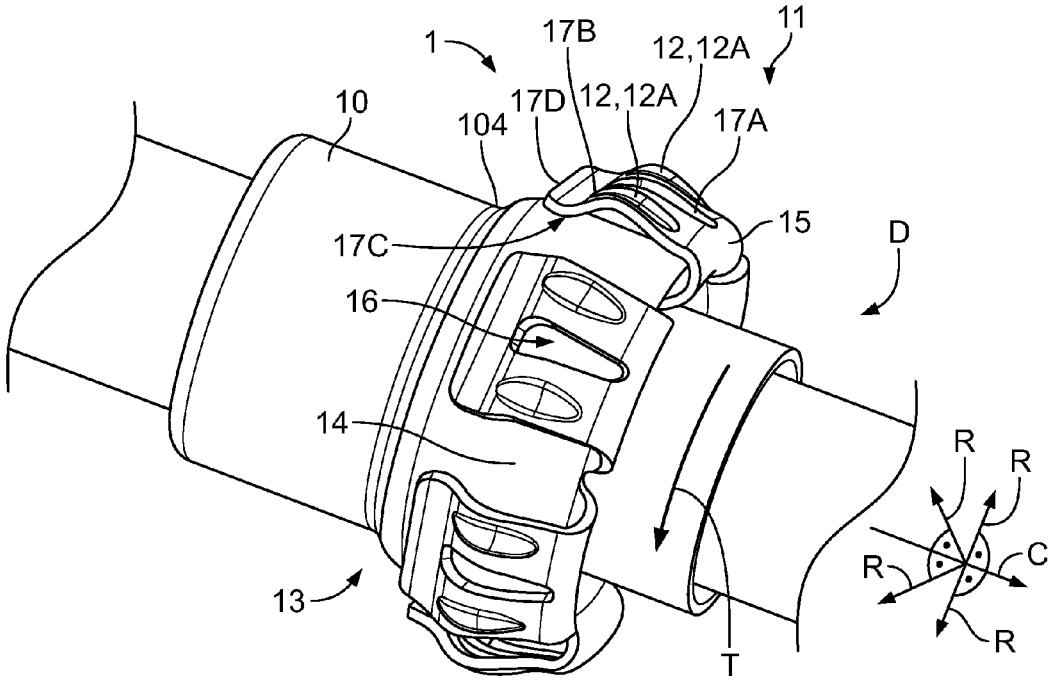
FIG. 2 is an enlarged perspective view of the shield sleeve illustrated in FIG. 1.

In the embodiment of FIG. 2, the shield sleeve 1 includes a sleeve member 13 and contact fingers 11 positioned on the sleeve member. The contact fingers 11 are positioned on a distal end D of the shield sleeve 1, extending integrally from the sleeve member 13, and may be formed by deep-drawing and punching a metal sheet.

In an embodiment of FIG. 2, the sleeve member 13 is rotationally symmetrical and includes the cylindrical first sleeve crimping member 10, a conically extending third transition member 104 and an annular shield sleeve base 14. The shield sleeve base 14 is cylindrical and has a diameter larger than the diameter of first sleeve crimping member 10.

The contact fingers 11 extend from the distal end D of the shield sleeve base 14. The contact fingers 11 are strip-like, tongue-like, or tab-like in shape. A contact finger base 15 of a contact finger 11 is integrally connected to the shield sleeve base 14 of the sleeve member 13 and extends outward therefrom along the cable direction C. At a distance from the shield sleeve base 14, the contact fingers 11 bend approximately 180° to the cable direction C and extend substantially counter to the cable direction C, being positioned over the shield sleeve base 14. Each contact finger 11 and the shield sleeve base 14, taken together, form an approximate U-shape. By bending, the contact finger base 15 serves as a cantilevered end of each contact finger 11, allowing an opposite free end (not labeled) to be resiliently deflected inward, counter to the radial direction R, and to protrude radially from the sleeve member 13. The plurality of contact fingers 11 are consequently positioned radially further outwards than the sleeve members 13.

Each contact finger 11 has two contacting protrusions 12 which protrude radially outwards from the contact finger 11. Consequently, each contacting protrusion 12 extends outward with respect to the sleeve member 13 and the contact fingers 11 positioned thereon.

In an embodiment, the contacting protrusions 12 have a convex, bowed-like or crimp-like shape. The bowed contacting protrusions 12A are rounded both in the cable direction C and in a circumferential extending, tangential direction T so that a relative movement of the shield sleeve 1 with respect to the first housing 4' can extend in both directions R, T with little damage.

A slot 16 is positioned between the two bowed contacting protrusions 12A, which the resilient force is optimized at the resilient deflection of the contact finger 11.

A distal end 17A of the contacting protrusion 12A, extends from a distal facing end of the contacting protrusion 12A, positioned adjacent to and continuously with the contact finger base 15, is bowed outwards from the contact finger base 15 along the tangential direction T. A proximate end 17B of the contacting protrusion 12A, extends continuously from the free end facing side of the contacting protrusion 12A, and curves inward, towards the sleeve member 13. A deflection limiting member 17C extends continuously from the proximate end 17B, having an inwardly bowed shape. A free end 17D of the contact finger 11 extends continuously from the deflection limiting member 17C and extends slightly outwards.

In a relaxed state, the deflection limiting member 17C is positioned a distance from the shield sleeve base 14 of the sleeve member 13. However, in the event of an inward deflection of the contact finger 11, for example, in a connected state, the deflection limiting member 17C contacts an outer surface of the shield sleeve base 14 to limit the inward movement of the contact finger 11. Since the shield sleeve base 14 is rounded in a cable direction C, inward movement of the deflection limiting member 17C towards the shield sleeve base 14 is possible with little damage.

As discussed above, the contact finger 11 is bent relative to the sleeve member 13 to form the approximate U-shape with the sleeve member 13, that is to say, it is bent back on the sleeve member 13. In the radial direction R, therefore, the contact finger 11 overlaps the sleeve member 13.

Figure 3:
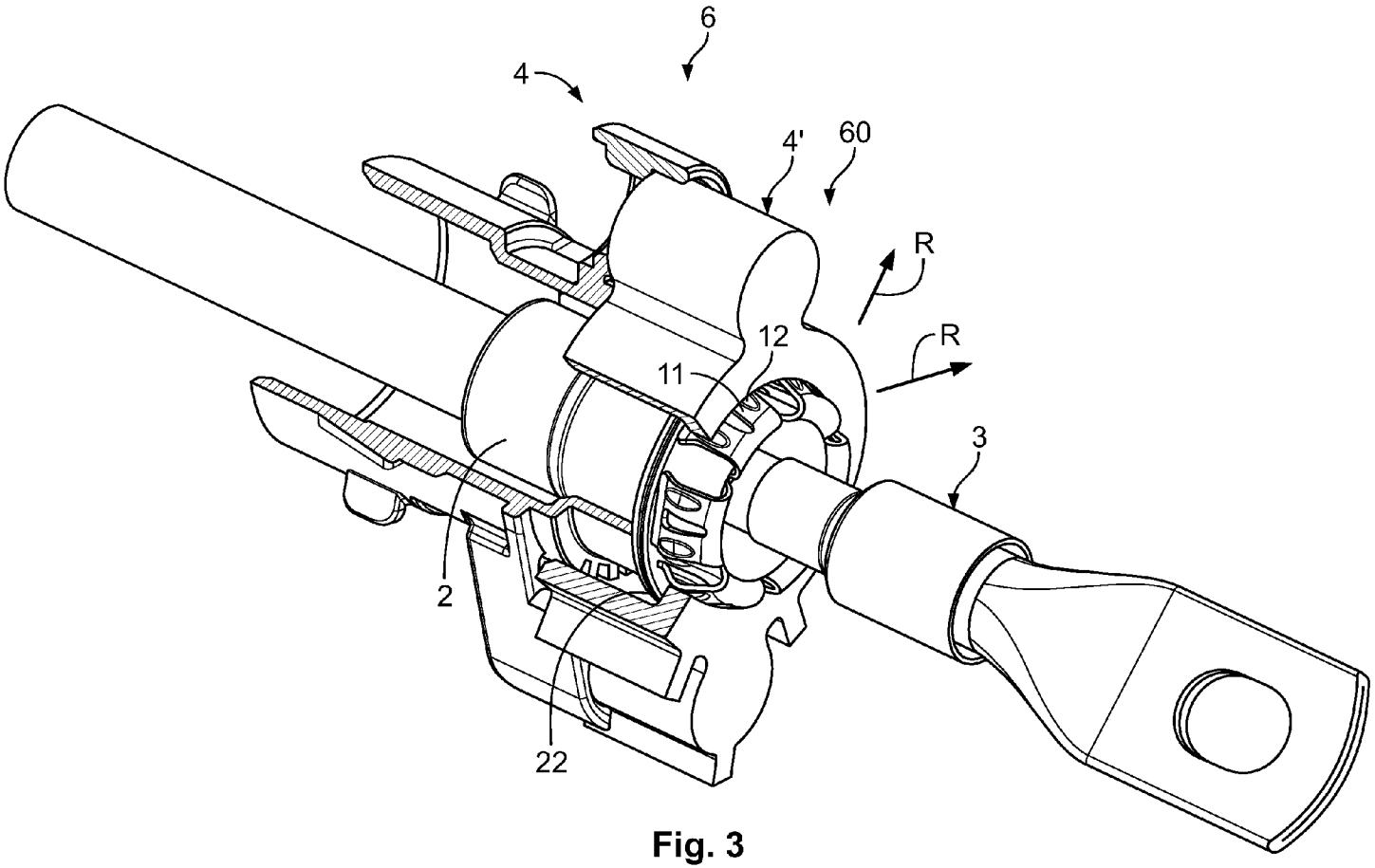
FIG. 3 is a perspective view of the elements from FIG. 1 in an assembled state.

In an embodiment of FIG. 3, when the elements of FIG. 1 are assembled, the contact fingers 11 are resiliently deflected inward with the contacting protrusions 12 contacting an inner surface of the first housing 4', and applying an outward radial force in a radial direction R against the first housing 4'. The shield sleeve receiving member 22 of the crimp sleeve 2 closes in a positive-locking manner with the first housing 4'. Electrical continuity between the shield sleeve 1, the crimp sleeve 2, the cable shielding layer (not shown), and the first housing 4' is established, permitting complete electromagnetic shielding in the end region 60 of the assembly 6 is thereby ensured.

The elements shown in FIG. 3 may be part of a connection element, by means of which it is possible to connect the cable 3 to other elements.

Figure 4:
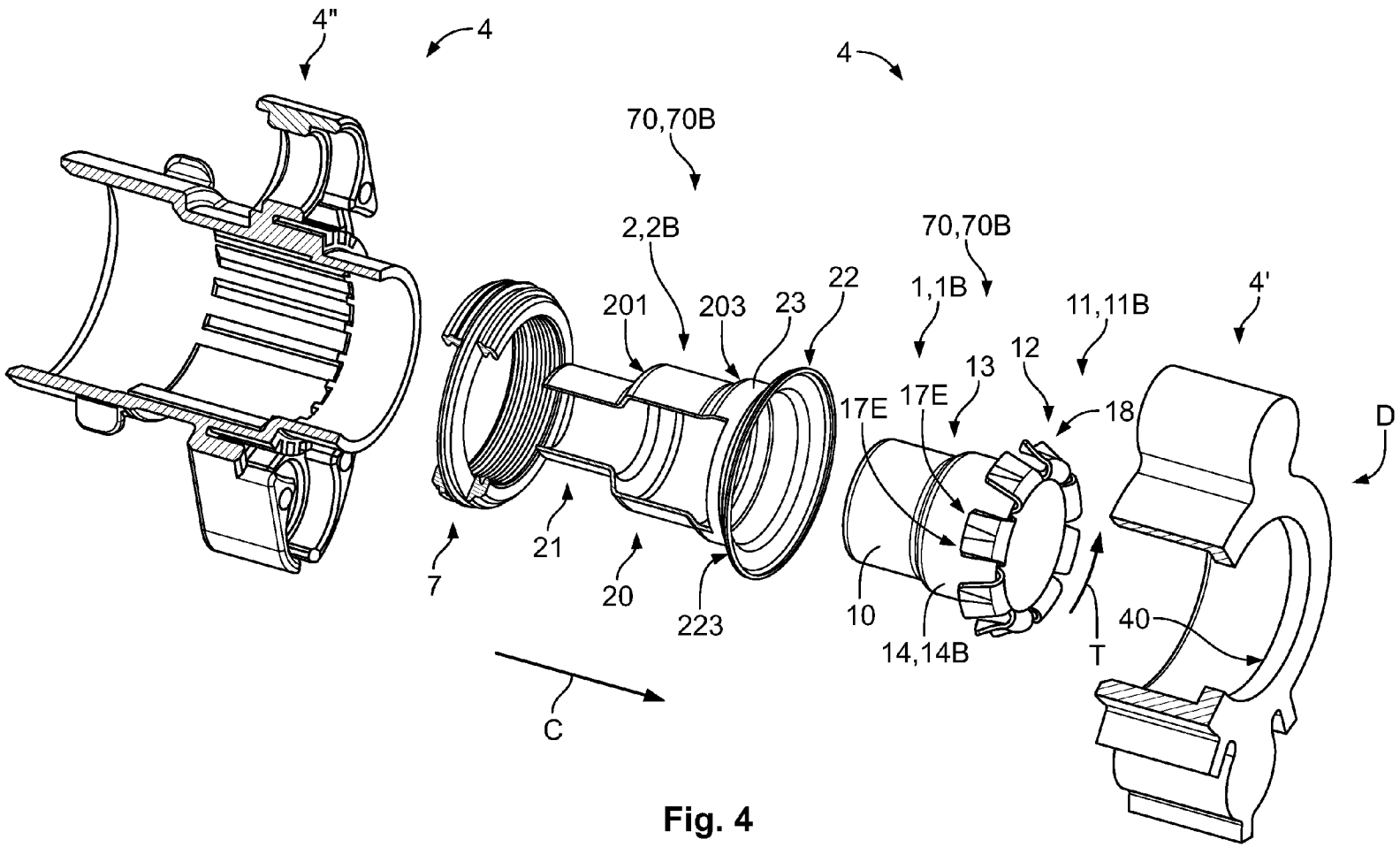
FIG. 4 is an exploded view of a shield sleeve, a crimp sleeve, a housing, and a seal in a preassembly state.

In an embodiment of FIG. 4, a shield sleeve 1,1B, a crimp sleeve 2,2B, a seal 7, and the housing 4 comprising a metal first housing 4' and a second housing 4" are shown. The crimp sleeve 2, the seal 7 and the two housing 4', 4" are shown in a partially sectioned manner.

The crimp sleeve 2B includes the cable crimping member 21, the transition region 201, the second sleeve crimping member 20 and the shield sleeve receiving member 22. Additionally, the crimp sleeve 2B includes a carrier portion 23 onto which the seal 7 is fitted, a conically shaped fourth transition member 203 extending between the second sleeve crimping member 20 and the carrier portion 23, and a conically shaped fifth transition member 223 extending between the shield sleeve receiving member 22 and the carrier portion 23. The transition members 201, 203, 223 have a conical shape. The crimp sleeve 2B is rotationally symmetrical, and may be pushed over the shield sleeve 1B. Thus, the crimp sleeve 2B is at least partially complementary to the shield sleeve 1B.

In order to produce a connection between the cable shielding layer (not shown) and the shield sleeve 1B, the cable shielding layer is fitted to the outer surface of the shield sleeve 1B and secured thereto. In an embodiment, the cable shielding layer is secured between the shield sleeve 1 and the crimp sleeve 2 by the first sleeve crimping member 10 of the shield sleeve 1 being crimped with the second sleeve crimping member 20 of the crimp sleeve 2. When crimped, the cable shielding layer is securely held between the shield sleeve 1 and the crimp sleeve 2. The connection produced in this manner on the cable crimping member 21 of the crimp sleeve 2 can be mechanically connected to the cable by the cable crimping member 21 being squeezed, whereby it becomes plastically deformed.

In an embodiment of FIG. 4, the shield sleeve 1B has an extended shield sleeve base 14B to compensate for the extended length of the crimp sleeve 2B, which is greater in the cable direction C than the crimp sleeve 2A, due to the carrier portion 23 extending in the cable direction C.

Figure 5:
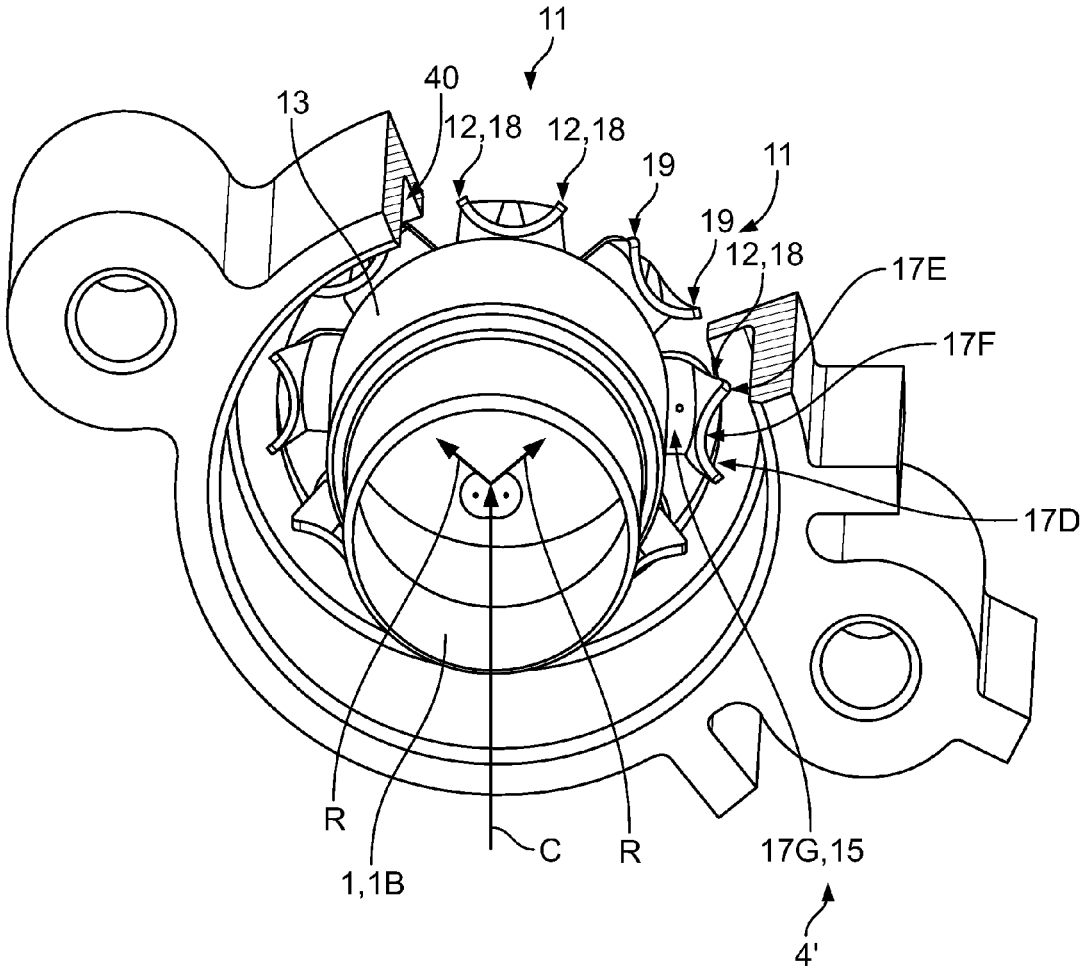
FIG. 5 is a perspective view of an end of the shield sleeve from FIG. 4, together with the housing.

In an embodiment of FIG. 4, contact fingers 11, 11B are positioned on the distal end D on the shield sleeve base 14. The contact finger 11B has substantially rectangular outer facing surface. The contact fingers 11B are resiliently connected to the shield sleeve base 14 at the distal end D through a contact finger base 15 (See FIG. 5), with the contact finger base 15 serving as a cantilevered end. Two corners 17E of the contact finger 11 positioned on an opposite proximate end of the contact finger 11B, bending radially outwards to form two contact wings 18. The proximate end of the cantilevered contact finger 11B is the free end 17D of the cantilever. The contact wings 18 protrude radially outwards, and when taken together, form an approximate U-shape or V-shape. When the shield sleeve 1 is connected to the first housing 4', a contacting protrusion 12 on the contact wing 18 contacts the inner edge 40 of the first housing 4', such as the embodiment shown in FIG. 5.

Due to the contact force acting in the cable direction C, which presses the shield sleeve 1,1B onto the first housing 4', the contact fingers 11 are resiliently deflected inward, opposite the radial direction, producing an outward resilient force which presses the contact wings 18 against the inner edge 40.

The contact fingers 11 and the contact wings 18 have cutting edges 19. These cutting edges 19 are sharp and score or cut the inner edge 40 of the first housing 4' so that any contamination or oxide layers on the surface of the inner edge 40 are penetrated. The cutting edges 19 extend in the cable direction C along the length of the contact fingers 11 so that a cutting action is automatically produced be the cutting edges 19 when the shield sleeve 1 is inserted into the first housing 4'. The contact fingers 11 have a curved cross-section at the free end 17D thereof. A center portion 17F of the free end 17D is closer to the sleeve member 13 than the corners 17E. Furthermore, the center portion 17F of the free end is substantially the same distance away from the sleeve member 13 as a center portion 17G of the contact finger base 15 of the contact finger 11B.

Figure 6:
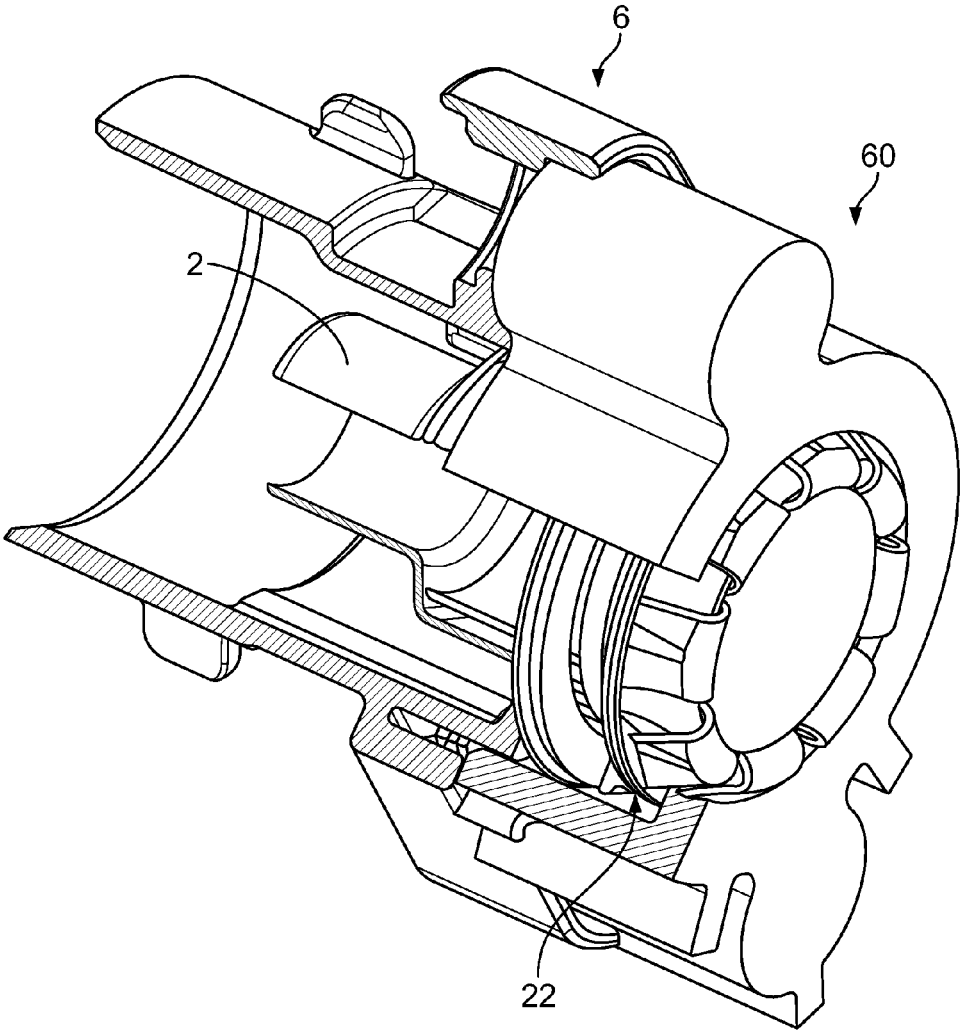
FIG. 6 is a partial perspective view of the elements from FIG. 4 in an assembled state.

In an embodiment of FIG. 6, the elements of FIG. 4 are shown in an assembled state. The shield sleeve receiving member 22 of the crimp sleeve 2 closes in a positive-locking manner with the first housing 4' of the housing 4. Electromagnetic shielding is thereby produced again in the end portion 60 of the assembly 6.

Figure 7:
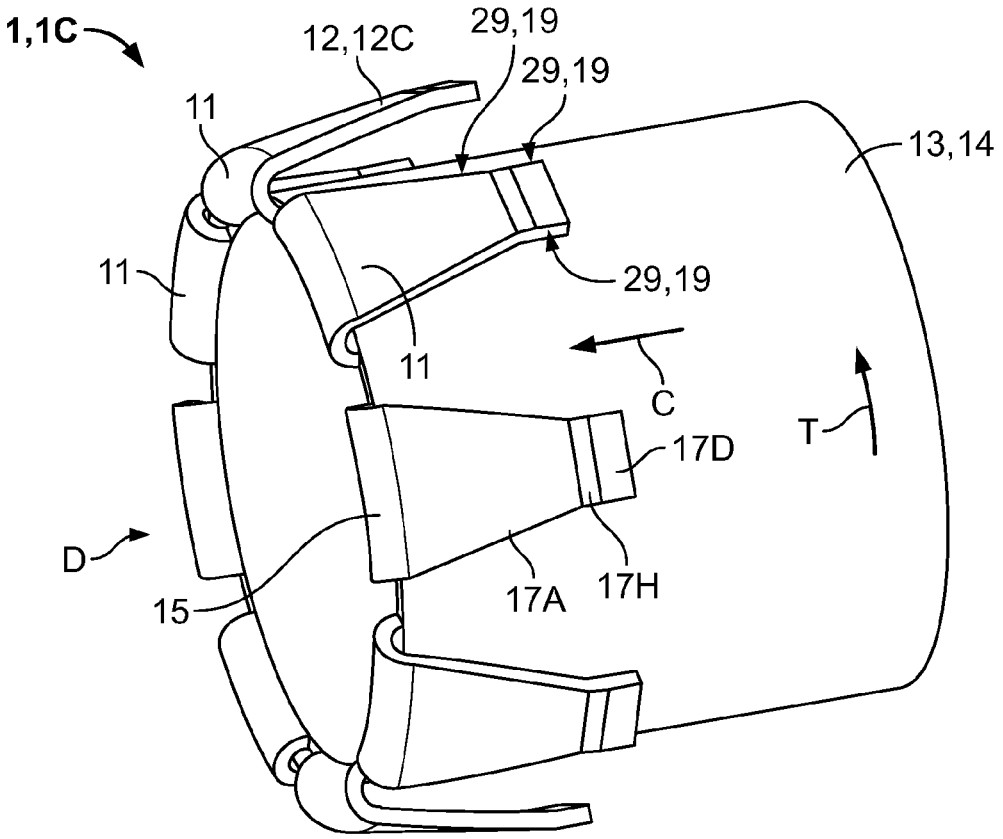
FIG. 7 is a perspective view of a shield sleeve.

In an embodiment of FIG. 7, a shield sleeve 1,1C again has a rotationally symmetrical sleeve member 13 having only a shield sleeve base 14. The shield sleeve base 14 is substantially cylindrical. A plurality of contact fingers 11 are positioned on a distal end D of the shield sleeve base 14A. In an embodiment, eight contact fingers 11 are positioned so as to be distributed in a uniform manner over the periphery of the cylinder. A uniform distribution of the resilient force which occurs is thereby achieved.

The contact fingers 11 each have contacting protrusions 12 in the form of contact faces 12C. The distal end 17A, which extends from a side of the contacting protrusion 12 and which continuously forms the contact finger base 15 of the contact finger 11, tapers counter to the cable direction C in a tangential direction T. The contact face 12C, measured at the free end 17D thereof in the tangential direction T, has a smaller width than the contact finger base 15. Furthermore, the distal end 17A, extends slightly outwards in a radial direction from the contact finger base 15. The contacting protrusions 12, in the form of contact faces 12C, thus protrude radially. Furthermore, each contact finger 11 has two cutting edges 29, which are positioned in and counter to the tangential direction T at the contact finger 11. These cutting edges 29 may scratch away contamination or oxide layers in the event of a tangential relative movement on a counter-edge to be contacted. A small contact resistance can thereby be achieved. The cutting edges 29 protrude only once in a radial direction with respect to the contact finger 11 but may nonetheless also cut through contamination or oxide layers on a counter-face. Therefore, the cutting edges 29 perform a similar function as the cutting edges 19.

In the embodiment of FIG. 7, the free end 17D of the contact fingers 11 is slightly angled inward, towards the sleeve member 13, so that the free end 17D can serve as a deflection limiter by contacting the crimp sleeve 2 in a well-defined manner.

The shield sleeve 1A, shown in the embodiment of FIG. 1, forms, together with the crimp sleeve 2A, a first shielding end element 70A. The shield sleeve 1B, shown in the embodiment of FIG. 4, forms, together with the crimp sleeve 2B, a second shielding end element 70B. Both embodiments 70A, 70B are advantageous embodiments, each having a bell-shaped shield sleeve receiving member 22 on the crimp sleeve 2, which can be connected to the corresponding first housing 4' in a positive-locking manner. In an embodiment, a bell-shaped shield sleeve receiving member 22 is optional.

One of ordinary skill in the art would understand that the above described embodiments are merely exemplary embodiments, in which the individual features, as described above, may be combined or omitted independently of each other. Reference numerals which are the same in the different drawings refer to objects which are substantially identical in each case.

Further, one of ordinary skill in the art would appreciate that the above described embodiments disclose a shield sleeve which ensures a secure, consistent contact resistance which is substantially independent of forces between the housing portions of a connection element.

Further, one of ordinary skill in the art would appreciate that the cable shielding layer may be fitted to the shield member, for example, by means of a soldered or welded connection.

What is claimed is:

1. A shield sleeve comprising:

a sleeve member having:

a first end; and at least one radially protruding contact finger having a cantilevered end connected to the first end and at least one contacting protrusion positioned proximate to an opposite free end and protruding outward in a radial direction with respect to the sleeve member, the cantilevered end bent relative to the sleeve member to form an approximate U-shape such that the contact finger overlaps the sleeve member in the radial direction.

2. The shield sleeve of claim 1, wherein the contact finger is resiliently deflectable inward in a radial direction, towards the sleeve member.

3. The shield sleeve of claim 1, wherein the sleeve member is rotationally symmetrical.

4. The shield sleeve of claim 1, wherein a portion of the contact finger is bent inwards in a radial direction, towards the sleeve member.

5. The shield sleeve of claim 1, wherein the contacting protrusion has a convex, outwardly extending crimp-like or bowed shape.

6. The shield sleeve of claim 1, wherein the contact finger further comprises at least one cutting edge extending radially outward.

7. The shield sleeve of claim 1, wherein the contact finger further comprises at least one contact wing extending radially outward, away from the sleeve member.

8. The shield sleeve of claim 7, wherein the contact finger further comprises two contact wings positioned proximate to the free end, taken together, form an approximate U-shape or V-shape.

9. The shield sleeve of claim 1, wherein the contact finger has a curved deflection limiting member positioned proximate to the free end.

10. The shield sleeve of claim 1, wherein the contact finger is tapered such that a width of the cantilevered end is greater than a width of the free end.

11. A shielding end element comprising:

a shield sleeve having:

a sleeve member having:

a first end, and at least one radially protruding contact finger having a cantilevered end connected to the first end and at least one contacting protrusion positioned proximate to an opposite free end and protruding outward in a radial direction with respect to the sleeve member, the cantilevered end bent relative to the sleeve member to form an approximate U-shape such that the contact finger overlaps the sleeve member in the radial direction; and a crimp sleeve partially complementary to the shield sleeve, and positionable over the shield sleeve.

12. The shielding end element of claim 11, wherein the crimp sleeve has a shield sleeve receiving member into which the contact finger is received when the crimp sleeve is positioned over the shield sleeve.

13. The shielding end element of claim 12, wherein an end of the shield sleeve receiving member connects to a metal housing in a positive-locking manner.

* * * * *